US011043326B2

(12) United States Patent
Chiang et al.

(10) Patent No.: US 11,043,326 B2
(45) Date of Patent: Jun. 22, 2021

(54) POWER TRANSFORMER AND CIRCUIT BOARD MODULE

(71) Applicants: LITE-ON ELECTRONICS (GUANGZHOU) LIMITED, Guangzhou (CN); Lite-On Technology Corporation, Taipei (TW)

(72) Inventors: Han-Ju Chiang, Taipei (TW); Chih-Tai Chen, Taipei (TW)

(73) Assignees: LITE-ON ELECTRONICS (GUANGZHOU) LIMITED, Guangzhou (CN); Lite-On Technology Corporation, Taipei (TW)

( * ) Notice: Subject to any disclaimer, the term of this patent is extended or adjusted under 35 U.S.C. 154(b) by 335 days.

(21) Appl. No.: 16/100,221

(22) Filed: Aug. 10, 2018

(65) Prior Publication Data

US 2019/0378645 A1 Dec. 12, 2019

(30) Foreign Application Priority Data

Jun. 8, 2018 (CN) ..... 201810586240.2

(51) Int. Cl.
*H01F 27/08* (2006.01)
*H01F 27/28* (2006.01)
*H01F 27/06* (2006.01)

(52) U.S. Cl.
CPC ..... *H01F 27/2852* (2013.01); *H01F 27/06* (2013.01); *H01F 27/08* (2013.01); *H01F 27/085* (2013.01); *H01F 2027/065* (2013.01)

(58) Field of Classification Search
CPC .... H01F 27/2852; H01F 27/08; H01F 27/085; H01F 27/06; H01F 2027/065; H01F 27/306; H01F 27/22; H01F 27/2847; H01F 2027/297; H01F 27/292; H01F 27/29; H01L 23/3677; H05K 1/181
See application file for complete search history.

(56) References Cited

U.S. PATENT DOCUMENTS

2012/0326829 A1* 12/2012 Matsuda ..... H01F 27/346 336/212
2014/0009251 A1* 1/2014 Hsu ..... H01F 27/2866 336/57
2015/0009001 A1 1/2015 Karrer et al.

FOREIGN PATENT DOCUMENTS

CN 202502877 10/2012
CN 204204609 3/2015
TW 200915362 4/2009

OTHER PUBLICATIONS

"Office Action of China Counterpart Application", dated Feb. 26, 2021, p. 1-p. 9.

* cited by examiner

*Primary Examiner* — Tuyen T Nguyen
(74) *Attorney, Agent, or Firm* — JCIPRNET

(57) ABSTRACT

A power transformer including at least one primary side conductive piece, at least one secondary side conductive piece, a first conductive strip pin, a second conductive strip pin and an iron core set is provided. The at least one secondary side conductive piece is stacked to the at least one primary side conductive piece along an axis. The first conductive strip pin and the second conductive strip pin extend from the at least one secondary side conductive piece, and are bent and extend along the axis. The iron core set is coupled to the at least one primary side conductive piece and the at least one secondary side conductive piece. A circuit board module is further provided.

5 Claims, 6 Drawing Sheets

POWER TRANSFORMER AND CIRCUIT BOARD MODULE

CROSS-REFERENCE TO RELATED APPLICATION

This application claims the priority benefit of China application Ser. No. 201810586240.2, filed on Jun. 8, 2018. The entirety of the above-mentioned patent application is hereby incorporated by reference herein and made a part of this specification.

BACKGROUND OF THE INVENTION

Field of the Invention

The invention relates to a power transformer and a circuit board module, and particularly relates to a power transformer and a circuit board module capable of offering an efficient heat dissipation effect.

Description of Related Art

Currently, a rectifier transistor in a power supply dissipates heat by fixing an additional heatsink, for example, the additional heatsink is fixed by locking or attaching to the rectifier transistor and thereby increasing the heat dissipation area to cool off by making use of the heatsink. Specifically, for a vertical (e.g., in the To-220 package) rectifier transistor, such rectifier transistor is normally fixed to a heatsink and soldered to the circuit board together with the heatsink. As for a surface-mounted (e.g., in the SO8 package, which is soldered to a small-sized circuit board) rectifier transistor, such rectifier transistor is also connected to an additional heatsink for heat dissipation. In other words, all of the conventional rectifier transistors dissipate heat by resorting to additional heatsinks. However, such configuration makes it necessary to preserve an additional space for the heatsink to be fixed in the power supply, and the overall size of the power supply is difficult to be reduced.

SUMMARY OF THE INVENTION

One or some exemplary embodiments of the invention provide a power transformer capable of offering an efficient heat dissipation effect.

One or some exemplary embodiments provide a circuit board module. A power transformer of the circuit board module is capable of offering an efficient heat dissipation effect to a rectifier transistor.

A power transformer according to an embodiment of the invention includes at least one primary side conductive piece, at least one secondary side conductive piece, a first conductive strip pin, a second conductive strip pin, and an iron core set. The at least one secondary side conductive piece is stacked to the at least one primary side conductive piece along an axis. The first conductive strip pin extends from the at least one secondary side conductive piece, and the first conductive strip pin is bent and extends along the axis. The second conductive strip pin extends from the at least one secondary side conductive piece, and second conductive strip pin is bent and extends along the axis. The iron core set is coupled to the at least one primary side conductive piece and the at least one secondary side conductive piece.

According to an embodiment of the invention, the power transformer further includes a board, a first heat dissipation member, and a second heat dissipation member. The iron core set, the at least one primary side conductive piece, and the at least one secondary side conductive piece are located on the board, the board includes a first hole, a second hole, a third hole, and a fourth hole, wherein the first conductive strip pin passes through the first hole, and the second conductive strip pin passes through the second hole. The first heat dissipation member has a first end and a second end opposite to each other. The first end is connected to the first conductive strip pin and the second end passes through the third hole. The second heat dissipation member has a third end and a fourth end opposite to each other. The third end is connected to the second conductive strip pin and the fourth end passes through the fourth hole.

According to an embodiment of the invention, the power transformer further includes a plurality of center tap conductive strip pins. The at least one secondary side conductive piece includes a plurality of secondary side conductive pieces, the first conductive strip pin extends from one of the secondary side conductive pieces, the second conductive strip pin extends from another one of the secondary side conductive pieces, and the center tap conductive strip pins respectively extend from the secondary side conductive pieces, and the center tap conductive strip pins are bent and extend along the axis.

According to an embodiment of the invention, the at least one primary side conductive piece includes a plurality of primary side conductive pieces, the at least one secondary side conductive piece includes a plurality of secondary side conductive pieces, and the primary side conductive pieces and the secondary side conductive pieces are alternately stacked respectively.

According to an embodiment of the invention, each of the at least one primary side conductive piece is in a flat annular shape, each of the at least one secondary side conductive piece is a flat annular shape, the iron core set penetrates through the at least one primary side conductive piece and the at least one secondary side conductive piece.

A circuit board module according to an embodiment of the invention includes a circuit board, a plurality of rectifier transistors, and a power transformer. The circuit board includes a first surface and a second surface opposite to each other. The rectifier transistors are disposed on the first surface of the circuit board, and each of the rectifier transistors includes a drain. The power transformer is disposed on the second surface of the circuit board. The power transformer includes at least one primary side conductive piece, at least one secondary side conductive piece, a first conductive strip pin, a second conductive strip pin, and an iron core set. The at least one secondary side conductive piece is stacked to the at least one primary side conductive piece along an axis. The first conductive strip pin extends from the at least one secondary side conductive piece, and the first conductive strip pin is bent and extends along the axis. The first conductive strip pin is conductive to a portion of the drains of the rectifier transistors. The second conductive strip pin extends from the at least one secondary side conductive piece, and the second conductive strip pin is bent and extends along the axis. The second conductive strip pin is conductive to another portion of the drains of the rectifier transistors. The iron core set is coupled to the at least one primary side conductive piece and the at least one secondary side conductive piece.

According to an embodiment of the invention, an orthogonal projection of the power transformer on the circuit board is overlapped with an orthogonal projection of the rectifier transistors on the circuit board.

According to an embodiment of the invention, the power transformer further includes a board, a first heat dissipation member, and a second heat dissipation member. The iron core set, the at least one primary side conductive piece, and the at least one secondary side conductive piece are located on the board, the board includes a first hole, a second hole, a third hole, and a fourth hole, the first conductive strip pin passes through the first hole, and the second conductive strip pin passes through the second hole. The first heat dissipation member has a first end and a second end opposite to each other. The first end is connected to the first conductive strip pin and the second end passes through the third hole. The second heat dissipation member has a third end and a fourth end opposite to each other. The third end is connected to the second conductive strip pin and the fourth end passes through the fourth hole.

According to an embodiment of the invention, the circuit board includes a plurality of first pads and a plurality of second pads located on the first surface, the first pads are located at a side of the rectifier transistors, the second pads are located at another side of the rectifier transistors, the first pads and the second pads are respectively conductive to the drains of the rectifier transistors, the first conductive strip pin and the second conductive strip pin are respectively inserted to the circuit board and connected to the first pads, and the first heat dissipation member and the second heat dissipation member are respectively inserted to the circuit board and connected to the second pads.

According to an embodiment of the invention, the circuit board module further includes a fan, disposed on the second surface of the circuit board, and the first conductive strip pin and the second conductive strip pin of the power transformer face toward the fan.

According to an embodiment of the invention, the axis is parallel to a normal direction of the circuit board.

According to an embodiment of the invention, the at least one primary side conductive piece includes a plurality of primary side conductive pieces, the at least one secondary side conductive piece includes a plurality of secondary side conductive pieces, and the primary side conductive pieces and the secondary side conductive pieces are alternately stacked respectively.

According to an embodiment of the invention, the power transformer further includes a plurality of center tap conductive strip pins. The at least one secondary side conductive piece includes a plurality of secondary side conductive pieces. The first conductive strip pin extends from one of the secondary side conductive pieces, and the second conductive strip pin extends from another one of the secondary side conductive pieces. The center tap conductive strip pins respectively extend from the secondary side conductive pieces, and are the center tap conductive strip bent and extend along the axis, and are inserted to the circuit board.

Each of the at least one primary side conductive piece is in a flat annular shape, each of the at least one secondary side conductive piece is a flat annular shape, the iron core set penetrates through the at least one primary side conductive piece and the at least one secondary side conductive piece.

Based on the above, the primary side conductive pieces and the secondary side conductive pieces of the power transformer according to the embodiments of the invention are stacked along the axis. In addition, the first conductive strip pin and the second conductive strip pin extend from the secondary side conductive pieces, and are bent and extend along the axis. In the circuit board module, according to the embodiments of the invention, the first conductive strip pin and the second conductive strip pin of the power transformer are conductive to the drains of the rectifier transistors by making use of the property that the drains of the rectifier transistors and the first conductive strip pin and the second conductive strip pin of the power transformer are at the same potential. In this way, when the rectifier transistors are in operation, the heat generated from the rectifier transistors is taken to the first conductive strip pin and the second conductive strip pin of the power transformer. In other words, in addition to transmitting electrical signals, the first conductive strip pin and the second conductive strip pin of the power transformer are further able to dissipate heat from the rectifier transistors. In this way, the rectifier transistors do not require an additional heatsink, and the overall size and weight of the device (e.g., a power supply) having the circuit board module can be reduced.

In order to make the aforementioned and other features and advantages of the invention comprehensible, several exemplary embodiments accompanied with figures are described in detail below.

BRIEF DESCRIPTION OF THE DRAWINGS

The accompanying drawings are included to provide a further understanding of the invention, and are incorporated in and constitute a part of this specification. The drawings illustrate embodiments of the invention and, together with the description, serve to explain the principles of the invention.

DESCRIPTION OF THE EMBODIMENTS

Figure 1:
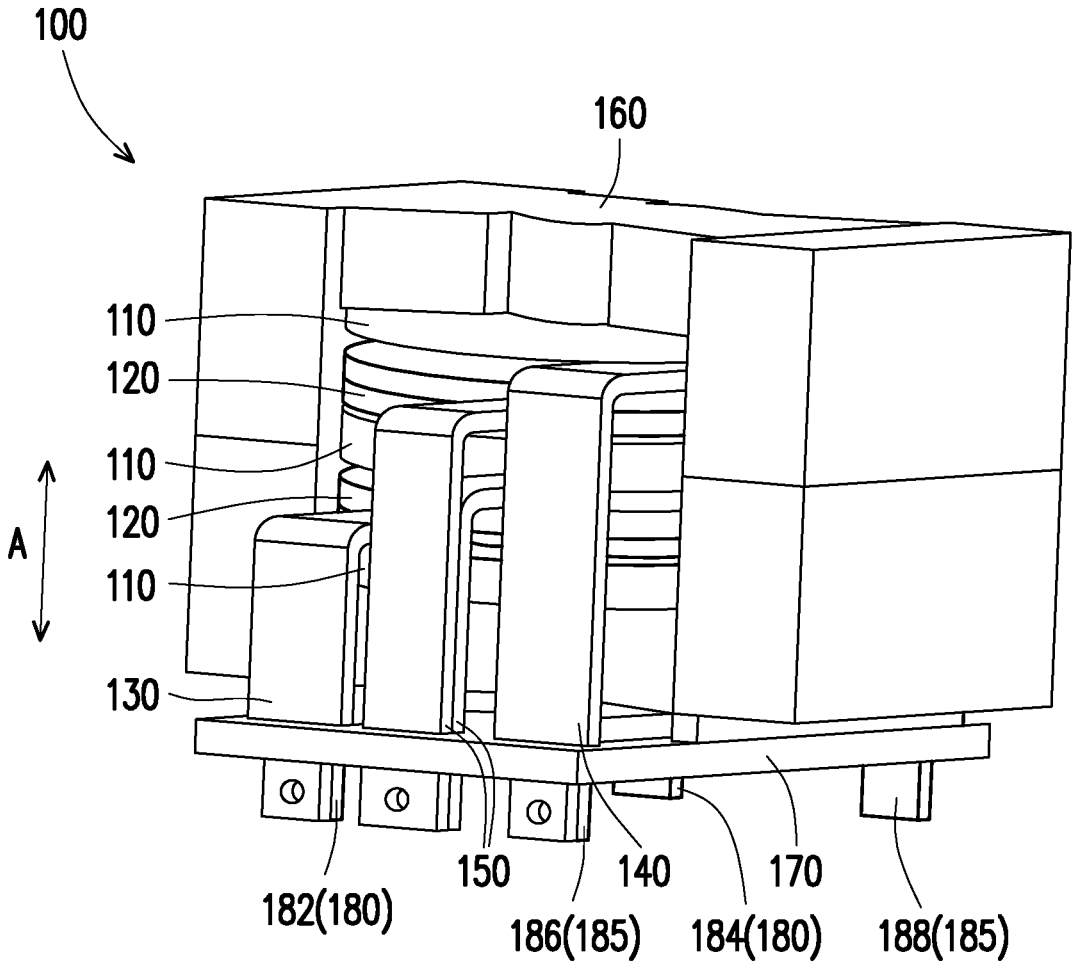
FIG. 1 is a schematic view illustrating a power transformer according to an embodiment of the invention.

Reference will now be made in detail to the present preferred embodiments of the invention, examples of which are illustrated in the accompanying drawings. Wherever possible, the same reference numbers are used in the drawings and the description to refer to the same or like parts.

Figure 2:
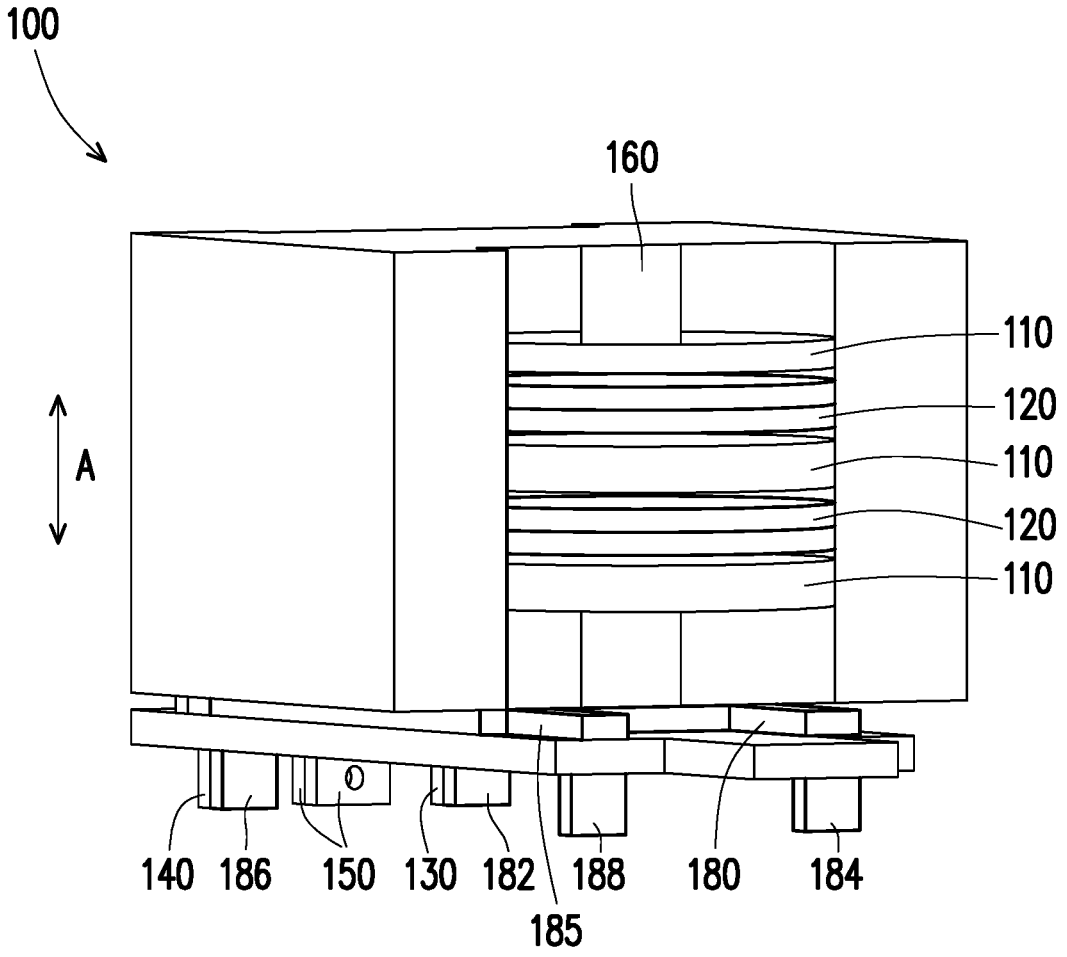
FIG. 2 is a schematic view of the power transformer of FIG. 1 from another perspective.
Figure 3:
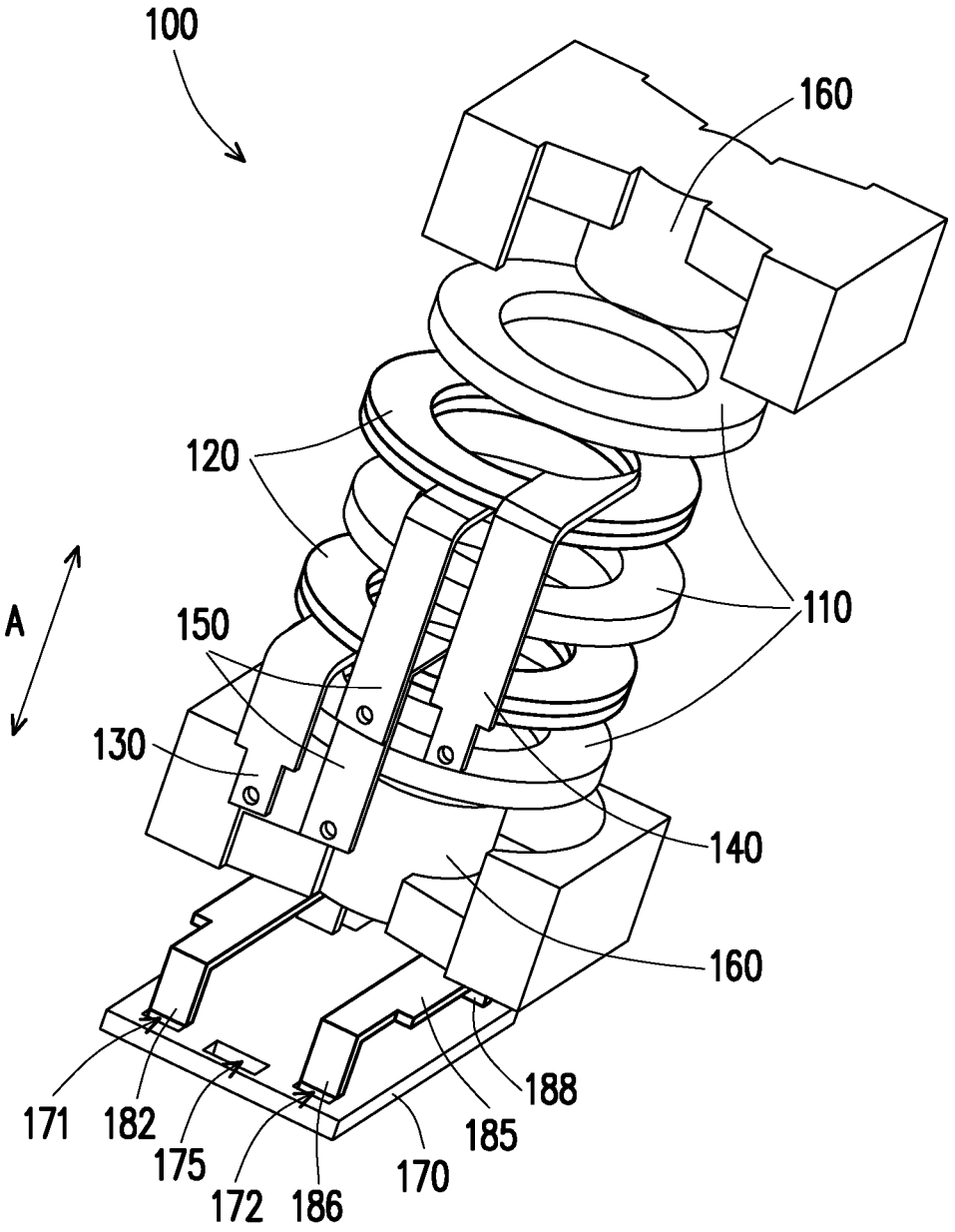
FIG. 3 is a schematic exploded view of the power transformer of FIG. 1.
Figure 4:
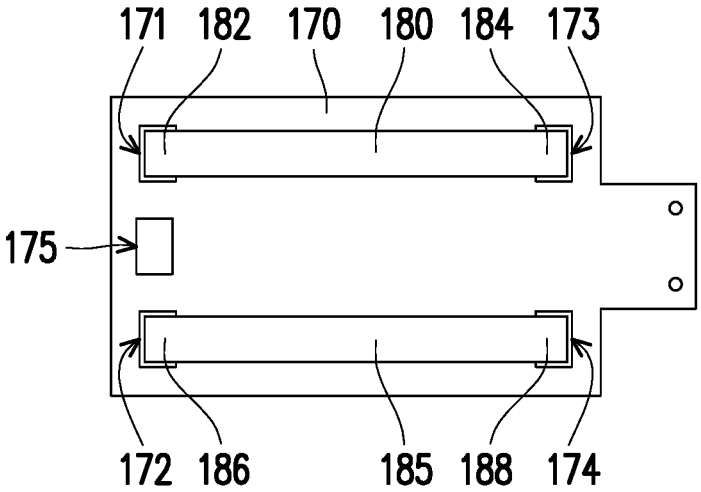
FIG. 4 is a schematic top view illustrating a board, a first heat dissipation member, and a second heat dissipation member of FIG. 1.

FIG. 1 is a schematic view illustrating a power transformer according to an embodiment of the invention. FIG. 2 is a schematic view of the power transformer of FIG. 1 from another perspective. FIG. 3 is a schematic exploded view of the power transformer of FIG. 1. FIG. 4 is a schematic top view illustrating a board, a first heat dissipation member, and a second heat dissipation member of FIG. 1.

Referring to FIGS. 1 to 4, a power transformer 100 of the embodiment includes at least one primary side conductive piece 110, at least one secondary side conductive piece 120, a first conductive strip pin 130, a second conductive strip pin 140, and an iron core set 160. The primary side conductive piece 110 and the secondary side conductive piece 120 are stacked along an axis A. In the embodiment, the at least one primary side conductive piece 110 includes multiple primary side conductive pieces 110, and the at least one secondary side conductive piece 120 includes multiple secondary side conductive pieces 120. In addition, the primary side conductive pieces 110 and the secondary side conductive pieces 120 are alternately stacked respectively. Further, in other embodiments, the numbers of the primary side conductive pieces 110 and the secondary side conductive pieces 120 and the way that the primary side conductive pieces 110 and the secondary side conductive pieces 120 are stacked are not limited to the above.

As shown in FIG. 3, in the embodiment, the first conductive strip pin 130 extends from one of the secondary side conductive pieces 120, and the first conductive strip pin 130 is bent and extends along the axis A. The second conductive strip pin 140 extends from another one of the secondary side conductive pieces 120, and the second conductive strip pin 140 is bent and extends along the axis A. Further, in other embodiments, the first conductive strip pin 130 and the second conductive strip pin 140 may also extend from the same secondary side conductive piece 120. Moreover, in the embodiment, the power transformer 100 may optionally include a plurality of center tap conductive strip pins 150. The center tap conductive strip pins 150 respectively extend from the secondary side conductive pieces 120, and the center tap conductive strip pins 150 are bent and extend along the axis A.

Specifically, as shown in FIG. 3, in the embodiment, the power transformer 100 includes two secondary side conductive pieces 120. The first conductive strip pin 130 and one of the center tap conductive strip pins 150 extend from the secondary side conductive piece 120 at the lower side and passes beside the primary side conductive piece at the lower side 110 after being bent. The second conductive strip pin 140 and the other center tap conductive strip pin 150 extend from the secondary side conductive piece 120 at the upper side, and pass beside the primary side conductive piece 110 and the secondary side conductive piece 120 at the lower side.

Besides, in the embodiment, the iron core set 160 is coupled to the primary side conductive pieces 110 and the secondary side conductive pieces 120. In the embodiment, each of the primary side conductive pieces 110 the secondary side conductive pieces 120 is in a flat annular shape. In other words, a hole is at the center of each of the primary side conductive pieces 110, and a hole is at the center of each of the secondary side conductive pieces 120. The iron core set 160 is divided into an upper part and a lower part which together penetrate through the primary side conductive pieces 110 and the secondary side conductive pieces 120 and are coupled to the primary side conductive pieces 110 and the secondary side conductive pieces 120. Further, in other embodiments, the form of the iron core set 160 is not limited thereto.

Besides, as shown in FIGS. 1 to 4, the power transformer 100 of the embodiment further includes a board 170, a first heat dissipation member 180, and a second heat dissipation member 185. The iron core set 160, the primary side conductive pieces 110, and the secondary side conductive pieces 120 are located on the board 170. As shown in FIG. 4, the board 170 includes a first hole 171, a second hole 172, a third hole 173, a fourth hole 174, and a fifth hole 174. In the embodiment, the first heat dissipation member 180 includes a first end 182 and a second end 184 opposite to each other. The first end 182 passes through the first hole 171 and the second end 184 passes through the third hole 173. The second heat dissipation member 185 includes a third end 186 and a fourth end 188 opposite to each other. The third end 186 passes through the second hole 172 and the fourth end 188 passes through the fourth hole 174. As shown in FIGS. 1 to 3, the first conductive strip pin 130 passes through the first hole 171, and the first end 182 of the first heat dissipation member 180 is connected to the first conductive strip pin 130. The second conductive strip pin 140 passes through the second hole 172, and the third end 186 of the second heat dissipation member 185 is connected to the second conductive strip pin 140. In addition, the center tap conductive strip pins 150 pass through a fifth hole 175.

Further, in the following description, how the power transformer 100 of the embodiment dissipates the heat from the rectifier transistor will be described.

Figure 5:
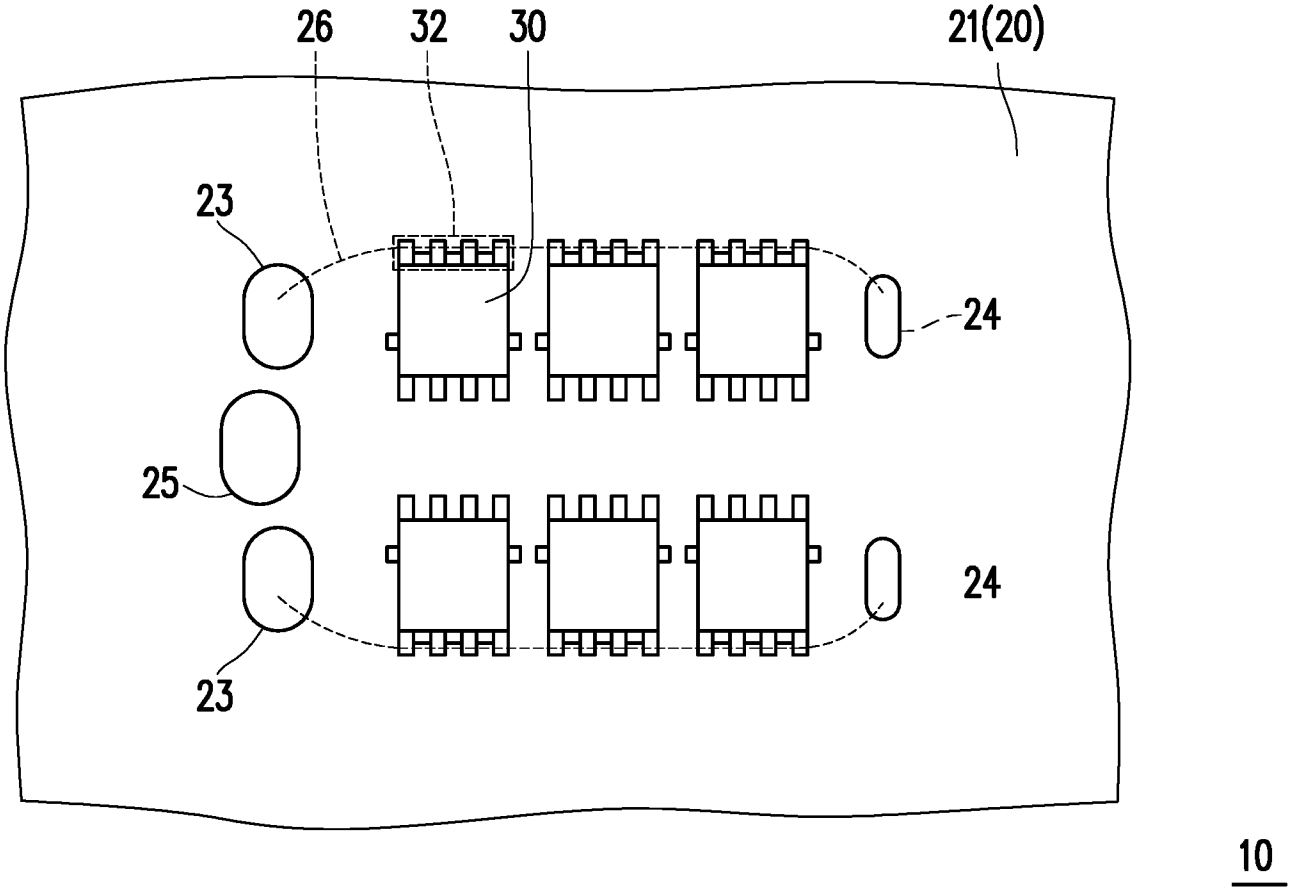
FIG. 5 is a partial schematic view illustrating a circuit board module according to an embodiment of the invention.
Figure 6:
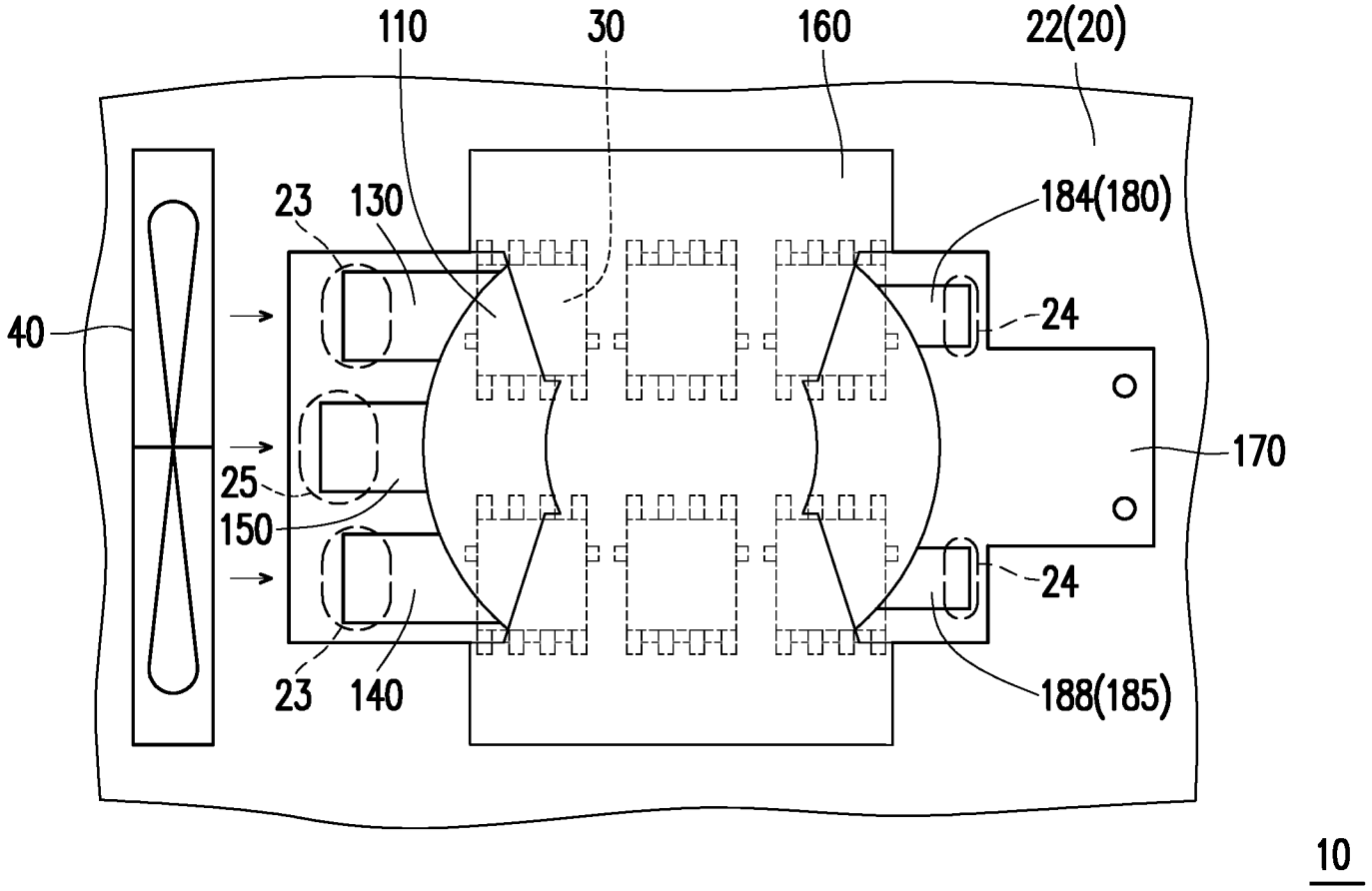
FIG. 6 is a schematic view illustrating another surface of the circuit board module of FIG. 5.

FIG. 5 is a partial schematic view illustrating a circuit board module according to an embodiment of the invention. FIG. 6 is a schematic view illustrating another surface of the circuit board module of FIG. 5. Referring to FIGS. 5 and 6, FIG. 5 illustrates a partial region on a first surface 21 of a circuit board 20, and FIG. 6 illustrates a corresponding region on a second surface 22 of the circuit board 20.

In the embodiment, a circuit board module 10 includes the circuit board 20, a plurality of rectifier transistors 30 (as shown in FIG. 5), and the power transformer 100 (as shown in FIG. 6). The circuit board 20 includes the first surface 21 (as shown in FIG. 5), and the second surface 22 (as shown in FIG. 6). As shown in FIG. 5, the rectifier transistors 30 are disposed on the first surface 21 of the circuit board 20, and each of the rectifier transistors 30 includes at least one drain 32. In the embodiment, the circuit board module 10 is described with an example with six rectifier transistors 30, where the rectifier transistors 30 are divided into an upper row and a lower row, and each of the rectifier transistors 30 includes four drains 32. However, the number and the configuration relationship of the rectifier transistors 30 of the circuit board module 10 and the number of the drains 32 of each of the rectifier transistors 30 are not limited to the example.

Besides, in the embodiment, the circuit board 20 includes a plurality of first pads 23 located on the first surface 21. The first pads 23 are located at a side of the rectifier transistors 30. The first pads 23 are respectively conductive to the drains 32 of the rectifier transistors 30. Specifically, in the embodiment, the number of the first pads 23 is two. The drains 32 of the three rectifier transistors 30 located at the upper row are connected to the first pad 23 at the upper side through a circuit 26, and the drains 32 of the three rectifier transistors 30 located at the lower row are connected to the first pad 23 at the lower side through the circuit 26.

As shown in FIG. 6, the power transformer 100 (labeled in FIG. 1) is disposed on the second surface 22 of the circuit board 20. In the embodiment, the axis A (labeled in FIG. 1) along which the first conductive strip pin 130 and the second conductive strip pin 140 of the power transformer 100 extend is parallel to a normal direction of the circuit board 20. In other words, the primary side conductive pieces 110 and the secondary side conductive pieces 120 (labeled in FIG. 1) of the power transformer 100 are stacked along the normal direction of the circuit board 20. As shown in FIG. 6, the orthogonal projection of the power transformer 100 on the circuit board 20 is overlapped with the orthogonal projection of the rectifier transistors 30 on the circuit board 20.

As shown in FIG. 6, in the embodiment, the first conductive strip pin 130 extends along the direction pointing into the drawing and is inserted to the circuit board 20. In addition, the first conductive strip pin 130 is connected to the first pad 23 located at a upper left position on the first surface 21 of the circuit board 20, and is conductive to the drains 32 of the rectifier transistors 30 of the upper row. The second conductive strip pin 140 extends along the direction pointing into the drawing and is inserted to the circuit board 20. In addition, the second conductive strip pin 140 is connected to the first pad 23 located at a lower left position on the first surface 21 of the circuit board 20 and is conductive to the drains 32 of the rectifier transistors 30 at the lower row.

In the circuit board module 10 of the embodiment, the first conductive strip pin 130 and the second conductive strip pin 140 of the power transformer 100 are conductive to the drains 32 of the rectifier transistors 30 by making use the property that the drains 32 of the rectifier transistors 30 and the first conductive strip pin 130 and the second conductive strip pin 140 of the power transformer 100 are at the same potential. In this way, while the rectifier transistors 30 are in operation, the heat generated from the rectifier transistors 30 are operating is taken to the first conductive strip pin 130 and the second conductive strip pin 140 of the power transformer 100. In other words, in addition to transmitting electrical signals, the first conductive strip pin 130 and the second conductive strip pin 140 of the power transformer 100 are further able to dissipate heat from the rectifier transistors 30.

It should be noted that, as shown in FIG. 5, in order to facilitate the efficiency of heat dissipation, the circuit board 20 of the embodiment may further optionally include a plurality of second pads 24 located on the first surface 21. The first pads 23 and the second pads 24 are respectively located at two opposite sides of the rectifier transistors 30. The second pads 24 are respectively conductive to the drains 32 of the rectifier transistors 30. Specifically, in the embodiment, the number of the second pads 24 is two. The drains 32 of the three rectifier transistors 30 located at the upper row are connected to the second pad 24 at the upper side through the circuit 26, and the drains 32 of the three rectifier transistors 30 located at the lower row are connected to the second pad 24 at the lower side through the circuit 26. Besides, in the embodiment, the circuit board 20 may further optionally include a third pad 25 located on the first surface 21. The center tap conductive strip pins 150 of the power transformer 100 may be inserted to the circuit board 20 and connected to the third pad 25.

In the embodiment, the first pads 23 and the second pads 24 are respectively disposed beside two opposite sides of the rectifier transistors 30. Since each row has three rectifier transistors 30, the distance between the rectifier transistor 30 on the right and the first pad 23 is longer than the distance between the rectifier transistor 30 on the right and the second pad 24. Therefore, when the rectifier transistor 30 on the right is in operation, the current may tend to flow toward the second pad 24, and the heat generated from the rectifier transistor 30 on the right also tends to be transmitted toward the second pad 24. By the design of disposing the first pads 23 and the second pads 24 beside two opposite sides of the rectifier transistors 30, the rectifier transistors 30 are able to transmit currents and heat through the first pads 23 and the second pads 24 on the two opposite sides.

Back to FIGS. 1, 2, and 6, in the embodiment, the first end 182 of the first heat dissipation member 180 and the first conductive strip pin 130 of the power transformer 100 are inserted to the circuit board 20 together and connected to the first pad 23 located at the upper left position on the first surface 21 of the circuit board 20. The second end 184 of the first heat dissipation member 180 of the power transformer 100 is inserted to the circuit board 20 and connected to the second pad 24 located at the upper right position on the first surface 21 of the circuit board 20. The third end 186 of the second heat dissipation member 185 and the second conductive strip pin 140 of the power transformer 100 are inserted to the circuit board 20 together and connected to the first pad 23 located at the lower left position on the first surface 21 of the circuit board 20. The fourth end 188 of the second heat dissipation member 185 of the power transformer 100 is inserted to the circuit board 20 and connected to the second pad 24 located at the lower right position on the first surface 21 of the circuit board 20.

Therefore, referring to FIGS. 5 and 6, a portion of the heat generated by the rectifier transistors 30 located at the upper row on the first surface 21 of the circuit board 20 may be transmitted leftward to the first conductive strip pin 130 sequentially via the circuit 26, the first pad 23, and the first end 182 of the first heat dissipation member 180, and a portion of the heat generated by the rectifier transistors 30 located at the upper row on the first surface 21 of the circuit board 20 may be further transmitted rightward to the first conductive strip pin 130 sequentially via the circuit 26, the second pad 24, the second end 184 of the first heat dissipation member 180, the first heat dissipation member 180, and the first end 182 of the first heat dissipation member 180.

Similarly, a portion of the heat generated by the rectifier transistors located at the lower row on the first surface 21 of the circuit board 20 may be transmitted leftward to the second conductive strip pin 140 sequentially via the circuit 26, the first pad 23, and the third end 186 of the second heat dissipation member 185, and a portion of the heat generated by the rectifier transistors 30 located at the lower row on the first surface 21 of the circuit board 20 may be further transmitted rightward to the second conductive strip pin 140 sequentially via the circuit 26, the second pad 24, the fourth end 188 of the second heat dissipation member 185, the second heat dissipation member 185, and the third end 186 of the second heat dissipation member 185.

In the embodiment, the power transformer 100 offers a large heat dissipation area by making use of the first conductive strip pin 130, the second conductive strip pin 140, the first heat dissipation member 180, and the second heat dissipation member 185, so as to facilitate heat dissipation. Besides, as shown in FIG. 6, the circuit board module 10 of the embodiment may further optionally include a fan 40 disposed on the second surface 22 of the circuit board 20. The air flow (which may be the air blown from or drawn to the fan 40) generated by the fan 40 is capable of quickly taking away the heat transmitted to the first conductive strip pin 130 and the second conductive strip pin 140, thereby cooling off the rectifier transistors 30. In the embodiment, the first conductive strip pin 130 and the second conductive strip pin 140 of the power transformer 100 face toward the fan 40. However, in other embodiments, the position relationship among the first conductive strip pin 130, the second conductive strip pin 140, and the fan 40 is not limited thereto. In addition, the fan 40 in FIG. 6 is merely shown for an illustrative purpose. The type of the fan 40 and the distance between the fan 40 and the power transformer 100 are not limited thereto.

In view of the foregoing, the primary side conductive pieces and the secondary side conductive pieces of the power transformer according to the embodiments of the invention are stacked along the axis. In addition, the first conductive strip pin and the second conductive strip pin extend from the secondary side conductive pieces, and are bent and extend along the axis. In the circuit board module, according to the embodiments of the invention, the first conductive strip pin and the second conductive strip pin of the power transformer are conductive to the drains of the rectifier transistors by making use of the property that the drains of the rectifier transistors and the first conductive strip pin and the second conductive strip pin of the power transformer are at the same potential. In this way, when the heat generated from the rectifier transistors are in operation, the heat is taken to the first conductive strip pin and the second conductive strip pin of the power transformer. In other words, in addition to transmitting electrical signals, the first conductive strip pin and the second conductive strip pin of the power transformer are further able to dissipate heat from the rectifier transistors. In this way, the rectifier transistors do not require an additional heatsink, and the overall size and weight of the device (e.g., a power supply) having the circuit board module can be reduced.

It will be apparent to those skilled in the art that various modifications and variations can be made to the structure of the present invention without departing from the scope or spirit of the invention. In view of the foregoing, it is intended that the present invention cover modifications and variations of this invention provided they fall within the scope of the following claims and their equivalents.

What is claimed is:

1. A power transformer, comprising:

at least one primary side conductive piece;

at least one secondary side conductive piece, stacked to the at least one primary side conductive piece along an axis;

a first conductive strip pin, extending from the at least one secondary side conductive piece, and bent and extending along the axis;

a second conductive strip pin, extending from the at least one secondary side conductive piece, and bent and extending along the axis;

an iron core set, coupled to the at least one primary side conductive piece and the at least one secondary side conductive piece;

a board, wherein the iron core set, the at least one primary side conductive piece, and the at least one secondary side conductive piece are located on the board;

a first heat dissipation member, having a first end and a second end opposite to each other, wherein the first end is connected to the first conductive strip pin; and a second heat dissipation member, having a third end and a fourth end opposite to each other, wherein the third end is connected to the second conductive strip pin.

2. The power transformer as claimed in claim 1, wherein the board comprises a first hole, a second hole, a third hole, and a fourth hole, the first conductive strip pin passes through the first hole, and the second conductive strip pin passes through the second hole, the second end passes through the third hole, and the fourth end passes through the fourth hole.

3. The power transformer as claimed in claim 1, further comprising:

a plurality of center tap conductive strip pins, wherein the at least one secondary side conductive piece comprises a plurality of secondary side conductive pieces, the first conductive strip pin extends from one of the secondary side conductive pieces, the second conductive strip pin extends from another one of the secondary side conductive pieces, and the center tap conductive strip pins respectively extend from the secondary side conductive pieces, and are bent and extend along the axis.

4. The power transformer as claimed in claim 1, wherein the at least one primary side conductive piece comprises a plurality of primary side conductive pieces, the at least one secondary side conductive piece comprises a plurality of secondary side conductive pieces, and the primary side conductive pieces and the secondary side conductive pieces are alternately stacked respectively.

5. The power transformer as claimed in claim 1, wherein each of the at least one primary side conductive piece is in a flat annular shape, each of the at least one secondary side conductive piece is a flat annular shape, the iron core set penetrates through the at least one primary side conductive piece and the at least one secondary side conductive piece.

* * * * *